United States Patent [19]

Miller

[11] Patent Number: 4,812,224

[45] Date of Patent: Mar. 14, 1989

[54] HYDROCRACKING PROCESS

[75] Inventor: Jeffrey T. Miller, Naperville, Ill.

[73] Assignee: Amoco Corporation, Chicago, Ill.

[21] Appl. No.: 124,283

[22] Filed: Nov. 23, 1987

[51] Int. Cl.[4] ..... C10G 47/16

[52] U.S. Cl. ..... 208/111; 208/112; 208/68; 502/64; 502/314; 502/315

[58] Field of Search ..... 208/111, 68, 112; 502/64, 79, 314, 315

[56] References Cited

U.S. PATENT DOCUMENTS

| | | | |
|---|---|---|---|
| 4,120,825 | 10/1978 | Ward | 502/66 |
| 4,401,556 | 8/1983 | Bezman et al. | 208/111 |
| 4,419,271 | 12/1983 | Ward | 502/79 |
| 4,503,023 | 3/1985 | Breck et al. | 502/60 |
| 4,556,478 | 12/1985 | Shiori et al. | 208/111 |
| 4,576,711 | 3/1986 | Ward et al. | 208/111 |
| 4,585,545 | 4/1986 | Yancey et al. | 208/68 |
| 4,648,958 | 3/1987 | Ward | 208/111 |
| 4,676,887 | 6/1987 | Fischer et al. | 208/68 |

*Primary Examiner*—Anthony McFarlane

*Attorney, Agent, or Firm*—Ekkehard Schoettle; William H. Magidson; Ralph C. Medhurst

[57] ABSTRACT

A hydrocarbon conversion process is disclosed involving the hydrocracking of a catalytic cycle oil in the presence of a catalyst having a nickel component, a tungsten component, and a support component containing a crystalline molecular sieve material present in an amount ranging from 10 to 40 wt. % based on the weight of the support component with the balance of the support component being alumina.

15 Claims, No Drawings

HYDROCRACKING PROCESS

BACKGROUND OF THE INVENTION

The present invention relates to a hydrocarbon conversion process. More particularly, this invention relates to the catalytic hydrocracking of hydrocarbons.

The hydrocracking of hydrocarbons is old and well-known in the prior art. These hydrocracking processes can be used to hydrocrack various hydrocarbon fractions such as reduced crudes, gas oils, heavy gas oils, topped crudes, shale oil, coal extract and tar extract wherein these fractions may or may not contain nitrogen compounds. Modern hydrocracking processes were developed primarily to process feeds having a high content of polycyclic aromatic compounds, which are relatively unreactive in catalytic cracking. The hydrocracking process is used to produce desirable products such as turbine fuel, diesel fuel, and middle distillate products such as naphtha and gasoline.

The hydrocracking process is generally carried out in any suitable reaction vessel under elevated temperatures and pressures in the presence of hydrogen and a hydrocracking catalyst so as to yield a product containing the desired distribution of hydrocarbon products.

Hydrocracking catalysts generally comprise a hydrogenation component on an acidic cracking support. More specifically, hydrocracking catalysts comprise a hydrogenation component selected from the group consisting of Group VIA metals and Group VIII metals of the Periodic Table of Elements, their oxides or sulfides. The prior art has also taught that these hydrocracking catalysts contain an acidic support comprising a crystalline alumino silicate material such as X-type and Y-type alumino silicate materials. This crystalline aluminosilicate material is generally suspended in a refractory inorganic oxide such as silica, alumina, or silica-alumina.

The preferred Group VIA metals are tungsten and molybdenum the preferred Group VIII metals are nickel and cobalt.

The prior art has also taught that combinations of metals for the hydrogenation component, expressed as oxides and in the order of preference, are: $NiO-WO_3$, $NiO-MoO_3$, $CoO-MoO_3$, and $CoO-WO_3$.

Other hydrogenation components broadly taught by the prior art include iron, ruthenium, rhodium, palladium, osmium, indium, platinum, chromium, molybdenum, vanadium, niobium, and tantalum.

References that disclose hydrocracking catalysts utilizing nickel and tungsten as hydrogenation components, teach enhanced hydrocracking activity when the matrix or catalyst support contains silica-alumina. For instance, U.S. Pat. Nos. 4,576,711, 4,563,434, and 4,517,073 all to Ward et al., show at Table V thereof that the lowest hydrocracking activity is achieved when alumina is used in the support instead of a dispersion of silica-alumina in alumina. The lowest hydrocracking activity is indicated by the highest reactor temperature required to achieve 60 vol. % conversion of the hydrocarbon components boiling above a predetermining end point to below that end point.

Similarly, U.S. Pat. No. 3,536,605 to Kittrell et al. teaches the use of silica-alumina in the catalyst support when a nickel- and tungsten-containing hydrogenation component is employed.

U.S. Pat. No. 3,598,719 to White teaches a hydrocracking catalyst that can contain 0 wt. % silica, i.e. less than 15 wt. % silica. However this patent further requires that a crystalline molecular sieve component be present in the catalyst in an amount of 30 to 70 wt. % based on total composite weight.

As can be appreciated from the above, there is a myriad of catalysts known for hydrocracking whose catalytic properties vary widely. A catalyst suitable for maximizing naphtha yield may not be suitable for maximizing the yield of turbine fuel. Further, the degree of cracking and yield structure is also dependent upon the feedstock composition.

Catalysts of high hydrogenation activity relative to acidity yield more highly saturated products as required in distillate fuels such as jet or aviation fuel.

In accordance with the process of the present invention a feedstock containing a light catalytic cycle oil is converted into naphtha plus high quality, i.e., low aromatic content distillates. The process of the present invention provides for the production of a hydrocracked product that possesses an aromatics content low enough that the total hydrocracked product can be distilled to produce a jet fuel fraction. Heretofore known hydrocracking processes suitable for handling light catalytic cycle oils generally produced distillate products that contained high concentrations of aromatic compounds that were thus unsuitable for blending into distillate fuels. This aromatics-containing distillate had to be hydrogenated at high pressures in a subsequent separate reaction zone over a noble metal-containing catalyst to produce jet fuel or be rehydrocracked into a gasoline fraction. The present invention provides for a process that permits a "once through operation" omitting any recycle of products such that the products contain naphtha and a finished distillate fuel or a blending component thereof.

SUMMARY OF THE INVENTION

This invention relates to a process for the hydrocracking of a feedstock comprising a light catalytic cycle oil which comprises reacting the light catalytic cycle oil with hydrogen at hydrocarbon hydrocracking conversion conditions in the presence of a catalytic composite comprising a combination of a nickel component, tungsten component, a crystalline molecular sieve material component, and an alumina component to obtain a distillate fuel product possessing a low aromatics content.

DETAILED DESCRIPTION OF THE INVENTION

The hydrocarbon charge stock subject to hydrocracking in accordance with the process of this invention is suitably a light catalytic cycle oil. This light catalytic cycle oil generally has a boiling range of about 350° to about 700° F., a sulfur content of about 0.5 to about 2.5 wt %, a nitrogen content of about 0.01 to about 0.15 wt % and an aromatics content of about 30 to about 70 vol. %. The light catalytic cycle oil is a product of the fluidized catalytic cracking process.

Operating conditions to be used in the hydrocracking reaction zone include an average catalyst bed temperature within the range of about 500° to 1000° F., preferably 600° to 900° F. and most preferably about 650° to about 850° F., a liquid hourly space velocity within the range of about 0.1 to about 10 volumes hydrocarbon per hour per volume catalyst, a total pressure within the range of about 500 psig to about 5,000 psig, and a hydrogen circulation rate of about 500 standard cubic feet to about 20,000 standard cubic feet per barrel.

Advantageously, the process of the present invention produces a hydrocarbon product stream that is favorable for use in the manufacture of jet fuels.

This product stream contains a distillate fraction that is sufficiently low in aromatics content such that the entire product stream can be distilled to produce a jet fuel fraction not requiring any further processing to reduce the aromatics content or the product stream can be distilled to produce a naphtha fraction where the distillate fraction is sufficiently low in aromatics content such that it can be used as a blending component for preparing jet fuel. The aromatics content of the distillate or distillate fraction prepared by the process of the invention is generally less than about 30 wt. % and preferably less than about 20 wt. %.

The process of the present invention is preferably carried out in a single reaction zone wherein the reaction zone can comprise a plurality of catalyst beds. Each catalyst bed can have intrabed quench to control temperature rise due to the exothermic nature of the hydrocracking reactions. The charge stock may be a liquid, vapor, or liquid-vapor phase mixture, depending upon the temperature, pressure, proportion of hydrogen, and particular boiling range of the charge stock processed. The source of the hydrogen being admixed can comprise a hydrogen-rich gas stream obtained from a catalytic reforming unit.

The catalyst used in the process of the present invention comprises a hydrogenation component and a catalyst support.

The hydrogenation component of the present invention comprises nickel and tungsten and/or their compounds. The nickel and tungsten are present in the amounts specified below. These amounts are based on the total catalytic composite or catalyst weight and are calculated as the oxides, NiO and $WO_3$. In another embodiment of the present invention, the hydrogenation component can additionally comprise a phosphorus component. The amount of phosphorus component is calculated as $P_2O_5$ with the ranges thereof also set out below.

| | Broad | Preferred | Most Preferred |
|---|---|---|---|
| NiO, wt % | 1–10 | 1.5–5.0 | 1.5–4.0 |
| $WO_3$, wt % | 10–30 | 15–25 | 15–20 |
| $P_2O_5$, wt % | 0.0–5.0 | 0.0–2.0 | 0.0–1.0 |

The hydrogenation component can be deposited upon the support by impregnation employing heat-decomposable salts of the above described metals or any other method well-known to those skilled in the art.

Each of the metals can be impregnated onto the support separately, or they may be co-impregnated onto the support.

Another component of the catalytic composite or catalyst is the support. The support comprises a crystalline molecular sieve material and alumina. The preferred alumina is gamma alumina. The crystalline molecular sieve material is present in an amount ranging from about 10 to about 40 wt. %, preferably from about 25 to about 35 wt. % based upon the total weight of the support. In contradistinction to the teachings of U.S. Pat. No. 3,598,719 to White, the present invention provides for a relatively high hydrocracking activity despite the reduced amount of crystalline molecular sieve material in the matrix.

Preferably, the crystalline molecular sieve material is distributed throughout and suspended in a porous matrix of the alumina. The process of the present invention requires the use of alumina in the catalyst support in contradistinction to U.S. Pat. Nos. 4,576,711, 4,563,434, and 4,517,073 to Ward et al. and U.S. Pat. No. 3,536,605 to Kittrell et al. which require the presence of silica-alumina matrix material.

The support may be prepared by various well-known methods and formed into pellets, beads, and extrudates of the desired size. For example, the crystalline molecular sieve material may be pulverized into finely divided material, and this latter material may be intimately admixed with the gamma alumina. The finely divided crystalline molecular sieve material may be admixed thoroughly with a hydrosol or hydrogel of the gamma alumina. Where a thoroughly blended hydrogel is obtained, this hydrogel may be dried and broken into pieces of desired shapes and sizes. The hydrogel may also be formed into small spherical particles by conventional spray drying techniques or equivalent means.

The molecular sieve materials of the invention can be selected from the group consisting of a faujasite-type crystalline aluminosilicate, a mordenite-type crystalline aluminosilicate, a ZSM-type crystalline aluminosilicate, and an AMS-type crystalline, metallosilicate. Examples of a faujasite-type crystalline aluminosilicate are high- and low-alkali metal Y-type crystalline aluminosilicates, metal-exchanged X-type and Y-type crystalline aluminosilicates, and ultrastable, large-pore crystalline aluminosilicate material. Zeolon is an example of a mordenite-type crystalline aluminosilicate. An example of a ZSM-type crystalline aluminosilicate is ZSM-5 crystalline aluminosilicate. AMS-1B crystalline borosilicate is an example of an AMS-type crystalline metallosilicate.

Ultrastable, large-pore crystalline aluminosilicate material is represented by Z-14US zeolites which are described in U.S. Pat. Nos. 3,293,192 and 3,449,070. Each of these patents is incorporated by reference herein and made a part hereof. By large-pore material is meant a material that has pores which are sufficiently large to permit the passage thereinto of benzene molecules and larger molecules and the passage therefrom of reaction products. For use in petroleum hydrocarbon conversion processes, it is often preferred to employ a large-pore molecular sieve material having a pore size of at least 5 Å (0.5 nm) to 10 Å (1 nm).

The ultrastable, large-pore crystalline aluminosilicate material is stable to exposure to elevated temperatures. This stability in elevated temperatures is discussed in the aforementioned U.S. Pat. Nos. 3,293,192 and 3,449,070. It may be demonstrated by a surface area measurement after calcination at 1,725° F. In addition, the ultrastable, large-pore crystalline aluminosilicate material exhibits extremely good stability toward wetting, which is defined as the ability of a particular aluminosilicate material to retain surface area or nitrogen-adsorption capacity after contact with water or water vapor. A sodium-form of the ultrastable, large-pore crystalline aluminosilicate material (about 2.15 wt % sodium) was shown to have a loss in nitrogen-absorption capacity that is less than 2% per wetting, when tested for stability to wetting by subjecting the material to a number of consecutive cycles, each cycle consisting of a wetting and a drying.

The ultrastable, large-pore crystalline aluminosilicate material that can be used for the catalytic composition of this invention exhibits a cubic unit cell dimension and hydroxyl infrared bands that distinguish it from other aluminosilicate materials. The cubic unit cell dimension of the preferred ultrastable, large-pore crystalline aluminosilicate is within the range of about 24.20 Angstrom units (Å) to about 24.55 Å. The hydroxyl infrared bands obtained with the preferred ultrastable, large-pore crystalline aluminosilicate material are a band near 3,745 $cm^{-1}$ (3,745±5 $cm^{-1}$), a band near 3,695 $cm^{-1}$ (3,690±10 $cm^{-1}$), and a band near 3,625 $cm^{-1}$ (3,610±15 $cm^{-1}$). The band near 3,745 $cm^{-1}$ may be found on many of the hydrogen-form and decationized aluminosilicate materials, but the band near 3,695 $cm^{-1}$ and the band near 3,625 $cm^{-1}$ are characteristic of the preferred ultrastable, large-pore crystalline aluminosilicate material that is used in the catalyst of the present invention.

The ultrastable, large-pore crystalline aluminosilicate material is characterized also by an alkaline metal content of less than 1%.

Other examples of crystalline molecular sieve materials that are suitable for the catalyst of the present invention are a high-sodium Y-type crystalline aluminosilicate such as the sodium-Y molecular sieve designated Catalyst Base 30-200 and obtained from the Linde Division of Union Carbide Corporation and a low-sodium Y-type molecular sieve designated as low-soda Diuturnal-Y-33-200 and obtained from the Linde Division of Union Carbide Corporation.

Another example of a crystalline molecular sieve zeolite that can be employed in the catalytic composition of the present invention is a metal-exchanged Y-type molecular sieve. Y-type zeolitic molecular sieves are discussed in U.S. Pat No. 3,130,007. The metal-exchanged Y-type molecular sieve can be prepared by replacing the original cation associated with the molecular sieve by a variety of other cations according to techniques that are known in the art. Ion exchange techniques have been disclosed in many patents, several of which are U.S. Pat. Nos. 3,140,249, 3,140,251, and 3,140,253. Specifically, a mixture of rare earth metals can be exchanged into a Y-type zeolitic molecular sieve and such rare earth metal-exchanged Y-type molecular sieve can be employed suitably in the catalytic composition of the present invention. Specific examples of suitable rare earth metals are cerium, lanthanum, and praseodymium.

Another zeolitic molecular sieve material that is used in the catalytic composition of the present invention is ZSM-5 crystalline zeolitic molecular sieves. Descriptions of the ZSM-5 composition and its method of preparation are presented by Argauer, et al., in U.S. Pat. No. 3,702,886. This patent is incorporated by reference herein and made a part hereof.

An additional molecular sieve that can be used in the catalytic composition of the present invention is AMS-1B crystalline borosilicate, which is described in U.S. Pat. No. 4,269,813, which patent is incorporated by reference herein and made a part thereof.

A suitable AMS-1B crystalline borosilicate is a molecular sieve material having the following composition in terms of mole ratios of oxides:

$0.9\pm0.2\ M_{2/n}O: B_2O_3: YSiO_2: ZH_2O$, wherein M is at least one cation having a valence of n, Y is within the range of 4 to about 600, and Z is within the range of 0 to about 160, and providing an X-ray diffraction pattern comprising the following X-ray diffraction lines and assigned strengths:

| d (Å) | Assigned Strength |
|---|---|
| 11.2 ± 0.2 | W-VS |
| 10.0 ± 0.2 | W-MS |
| 5.97 ± 0.07 | W-M |
| 3.82 ± 0.05 | VS |
| 3.70 ± 0.05 | MS |
| 3.62 ± 0.05 | M-MS |
| 2.97 ± 0.02 | W-M |
| 1.99 ± 0.02 | VW-M |

Mordenite-type crystalline aluminosilicates can be employed in the catalyst of the present invention. Mordenite-type crystalline aluminosilicate zeolites have been discussed in patent art, e.g., by Kimberlin in U.S. Pat. No. 3,247,098, by Benesi, et al., in U.S. Pat. No. 3,281,483, and by Adams, et al., in U.S. Pat. No. 3,299,153. Those portions of each of these patents which portions are directed to mordenite-type aluminosilicates are incorporated by reference and made a part hereof.

The following example shows how the process of the invention can be used to convert light catalytic cycle oil to a product containing a relatively low aromatics content. This product can be distilled to prepare jet fuel or distilled to prepare jet fuel blending components and high octane naphtha.

EXAMPLE

The process of the invention was compared with several alternative processes utilizing hydrocracking catalysts of differing compositions.

Each comparative catalyst and the catalysts in accordance with the invention were used to convert a light catalytic cycle oil feedstock to naphtha and distillate products. The reactor used in each test contained a total of 18.75 grams of 14/20 mesh size crushed catalyst. Each catalyst was sulfide in a 8% $H_2S$ hydrogen-containing stream at 200 psig at 350° F. followed by 650° F. Each catalyst was contacted with the feedstock at conversion conditions for at least a week before data was taken. The reaction conditions were adjusted such that 77 vol % of the feed was hydrocracked to material having a boiling range less than 380° F.

Table 1 below sets out the properties of the light catalytic cycle oil feedstock used in each test run.

TABLE 1

| Feed Properties | |
|---|---|
| API gravity | 21.9 |
| C, % | 89.58 |
| H, % | 10.37 |
| S, % | 0.55 |
| N, ppm | 485 |
| Total aromatics, wt % | 69.5 |
| Polyaromatics, wt % | 42.2 |
| Simulated distillation, °F. | |
| IBP, wt % | 321 |
| 10 | 409 |
| 25 | 453 |
| 50 | 521 |
| 75 | 594 |
| 90 | 643 |
| FBP | 756 |

The following Table 2 sets out the composition of each catalyst used in the present example to convert the feed described in Table 1. Catalysts D, F, and G are in accordance with the present invention whereas the remaining catalysts are comparative.

The comparative catalysts differ from the catalyst used in the process of the invention in various ways. Comparative catalyst A contains molybdenum, not in accordance with the present invention. Comparative catalyst B has a support containing silica-alumina not in accordance with the present invention. Comparative catalyst C contains cobalt, molybdenum and a silica-alumina matrix not in accordance with the present invention. Catalysts B and C are both commercially available. Catalyst E contains a high crystalline alumina silicate content, outside the scope of the present invention. Finally, commercially available hydrocracking catalyst D is also outside the scope of the present invention since it contains molybdenum and a high molecular sieve content.

TABLE 2

Hydrocracking Catalyst Compositions

| Catalyst | Metals (wt %) | Support | % USY Zeolite |
|---|---|---|---|
| A | $NiO(3.5)MoO_3(18.0)P_2O_5(3.0)$ | $\gamma$-$Al_2O_3$ | 35 |
| B | $NiO(2.0)WO_3(18.0)$ | $SiO_2$—$Al_2O_3$ | 35 |
| C | $CoO(3.0)MoO_3(10.0)$ | $SiO_2$—$Al_2O_3$ | 35 |
| D (inv.) | $NiO(2.0)WO_3(18.0)$ | $\gamma$-$Al_2O_3$ | 35 |
| E | $NiO(2.0)WO_3(18.0)$ | $\gamma$-$Al_2O_3$ | 50 |
| F (inv.) | $NiO(2.0)WO_3(18.0)P_2O_5(0.75)$ | $\gamma$-$Al_2O_3$ | 35 |
| G (inv.) | $NiO(6.0)WO_3(18.0)$ | $\gamma$-$Al_2O_3$ | 35 |
| H | NiO $MoO_3$ | Unknown | High |

The following Table 3 sets out the reaction conditions, conversion, relative hydrocracking activities and selectivities for each test run. The reactor catalyst loadings are also set out.

TABLE 3

Product Selectivities

| Run No. | 1 | 2 | 3 | 4 | 5 | 6 | 7 | 8 |
|---|---|---|---|---|---|---|---|---|
| Catalyst loading, g: | 18.75 A | 6.25 B<br>12.50 C | 6.25 D<br>12.50 H | 18.75 H | 6.25 D<br>12.50 E | 18.75 F | 18.75 D | 18.75 G |
| Reaction conditions: | | | | | | | | |
| Pressure, psi | 1250 | 1250 | 1250 | 1250 | 1250 | 1250 | 1250 | 1250 |
| WHSV, $hr^{-1}$ | 1.58 | 1.57 | 1.56 | 1.44 | 1.57 | 1.69 | 1.66 | 1.87 |
| Temp., °F. | 726 | 724 | 705 | 703 | 710 | 701 | 706 | 715 |
| Conversion, wt % (less than 380° F.) | 76.0 | 76.9 | 76.7 | 76.6 | 77.1 | 77.0 | 76.7 | 77.5 |
| Selectivity, wt % | | | | | | | | |
| Dry gas | 3.55 | 3.93 | 3.98 | 3.49 | 3.08 | 2.47 | 2.68 | 2.90 |
| Butane | 8.22 | 8.58 | 9.20 | 8.21 | 8.07 | 8.15 | 8.13 | 7.57 |
| Pentane | 7.61 | 7.93 | 7.67 | 7.61 | 7.27 | 7.44 | 7.09 | 6.76 |
| $C_6$–180° F. | 11.62 | 11.50 | 11.31 | 11.43 | 11.98 | 12.67 | 11.72 | 11.61 |
| 180°–380° F. | 44.96 | 44.93 | 44.56 | 45.84 | 46.71 | 46.20 | 47.16 | 48.67 |
| 380°: | 24.00 | 23.10 | 23.30 | 23.40 | 22.90 | 23.00 | 23.30 | 22.50 |
| Relative activity | 0.95 | 1.00 | 1.45 | 1.50 | 1.40 | 1.80 | 1.70 | 1.60 |

Table 4 below sets out the product analysis for each test run described in Table 3.

TABLE 4

Product Analysis

| Run No. | 1 | 2 | 3 | 4 | 5 | 6 | 7 | 8 |
|---|---|---|---|---|---|---|---|---|
| Total product | | | | | | | | |
| API gravity | 49.7 | 40.5 | 49.1 | 48.8 | 52.1 | 51.8 | 52.7 | 52.2 |
| % C | 86.75 | 86.80 | 86.66 | 86.70 | 86.13 | 85.95 | 85.90 | 86.08 |
| % H | 13.24 | 13.20 | 13.34 | 13.30 | 13.87 | 14.05 | 14.10 | 13.92 |
| Total aromatics, wt % | 31.9 | 36.0 | 31.2 | 32.5 | 20.6 | 14.4 | 15.0 | 18.4 |
| Polyaromatics, wt % | 0.3 | 0.4 | 0.4 | 0.3 | 0.1 | 0.4 | 0.0 | 0.0 |
| Naphtha | | | | | | | | |

TABLE 4-continued

Product Analysis

| Run No. | 1 | 2 | 3 | 4 | 5 | 6 | 7 | 8 |
|---|---|---|---|---|---|---|---|---|
| API gravity | 51.3 | 56.8 | N/A | 51.0 | 53.8 | 57.2 | 55.4 | 56.4 |
| % C | 86.84 | 86.45 | 87.03 | 86.76 | 86.26 | 85.93 | 85.99 | 86.18 |
| % H | 13.16 | 13.55 | 12.97 | 13.24 | 13.74 | 14.07 | 14.01 | 13.84 |
| Paraffins, wt % | 31.6 | 39.3 | 27.5 | 30.3 | 31.4 | 35.2 | 33.8 | 34.6 |
| Naphthenes, wt % | 39.6 | 31.2 | 44.7 | 41.0 | 49.9 | 51.9 | 52.6 | 49.2 |
| Aromatics, wt % | 28.8 | 29.5 | 27.8 | 28.7 | 18.7 | 13.0 | 13.6 | 16.3 |
| Distillate, wt % | | | | | | | | |
| API gravity | 35.6 | 35.6 | N/A | 35.9 | 39.3 | 41.4 | 40.1 | 40.1 |
| % C | 87.38 | 87.79 | 87.27 | 88.12 | 86.77 | 86.38 | 86.42 | 86.19 |
| % H | 12.62 | 12.21 | 12.73 | 12.62 | 12.23 | 13.62 | 13.58 | 13.81 |
| Total aromatics, wt % | 49.6 | 56.0 | 47.0 | 48.4 | 31.3 | 17.0 | 20.2 | 26.3 |
| Polyaromatics, wt % | 3.0 | 3.3 | 3.0 | 2.7 | 1.1 | 1.1 | 1.0 | 1.1 |

DISCUSSION OF RESULTS

An examination of the relative activities for each run set out in Table 3 demonstrates the superior cracking activity of the process of the invention. The relative hydrocracking activity was determined by using the following equation:

$$\text{relative activity} = e^{-35{,}000/R\left(\frac{1}{T} - \frac{1}{T_{ref}}\right)}$$

where

R = 1.987 cal/°k.

$T_{ref}$ = 657.6° K. (724° F.)

T = temperature of reactor at test run conditions 35,000 cal is the activation energy for the hydrocracking reaction.

Surprisingly, the catalysts of the invention, D, F, and G, displayed a higher hydrocracking activity than catalyst E which contained a greater amount of crystalline alumino silicate. Generally, the prior art has taught that the greater the amount of crystalline alumino silicate present in the catalyst, the greater the amount of cracking activity. Specifically, in run no. 5 where about two-thirds of the catalyst in the bed is catalyst E, the activity is markedly less than the activity afforded by catalysts of the invention, notwithstanding the presence of invention catalyst D in run no. 5.

Table 4 shows the relatively low aromatics content for the total product and the distillate fraction thereof yielded by practicing the process of the invention in run nos. 6 through 8, catalysts F, D, and G respectively. Generally jet fuel specifications stipulate an aromatics content of less than 20 vol. %. Only the process of the invention produced distillate fractions having an aromatics-contents less than about 20 wt. %; i.e., 17 and 20.2 wt. % for runs 6 and 7. The distillate fraction produced in ivention run 8 is sufficient to permit its use as a blending component in the preparation of jet fuel. Thus, distillate fraction of products yielded by the process of the invention can be either used directly as jet fuel or as a blended component without requiring a further reaction or processing step.

What is claimed is:

1. A process for the hydrocracking of a feedstock comprising a light catalytic cycle oil having a boiling range from about 350° F. to about 700° F. which comprises reacting the feedstock with hydrogen at hydrocracking conversion conditions in the presence of a catalyst comprising a hydrogenation component comprising a nickel component and a tungsten component wherein the nickel component is present in an amount ranging from about 1 to about 10 wt. % and the tungsten component is present in an amount ranging from about 10 to about 30 wt. %, both calculated as oxides and based on the total catalyst weight and a support component consisting essentially of a crystalline molecular sieve component and an alumina component wherein the crystalline molelcular sieve component is present in the support in an amount less than about 40 wt. % and greater than about 10 wt. % based on the total weight of the support component.

2. The process of claim 1 wherein said hydrogenation component also contains a phosphorus component present in an amount ranging from about 0.0 to 5.0 wt. % calculated as the oxide and based on total catalyst weight.

3. The process of claim 1 wherein said alumina component is gamma alumina.

4. The process of claim 1 wherein said crystalline molecular sieve component is a Y zeolite.

5. The process of claim 1 wherein said light catalytic cycle oil contains at least about 30 vol. % aromatics.

6. The process of claim 1 wherein said nickel component is present in an amount ranging from about 1.5 to about 5.0 wt. %, said tungsten component is present in an amount ranging from about 15 to about 25 wt. %, both calculated as oxides, and said crystalline molecular sieve component is present in an amount less than about 35 wt. % and greater than about 25 wt. % based on the weight of said support component.

7. The process of claim 6 wherein said hydrogenation component also contains a phosphorus component present in an amount ranging from about 0.0 to about 2.0 wt. % calculated as the oxide and based on total catalyst weight.

8. The process of claim 6 wherein said alumina component is gamma alumina.

9. The process of claim 6 wherein said crystalline molecular sieve component is a Y-type zeolite.

10. The process of claim 6 wherein said light catalytic cycle oil contains at least about 30 vol. % aromatics.

11. The process of claim 1 wherein said nickel component is present in an amount ranging from about 1.5 to about 4.0 wt. %, said tungsten component is present in an amount ranging from about 15 to about 20 wt. %, both calculated as oxides, and said crystalline molecular sieve component is present in an amount less than about 35 wt. % and greater than about 25 wt. % based on the weight of said support component.

12. The process of claim 11 wherein said hydrogenation component also contains a phosphorus component present in an amount ranging from about 0.0 to about 1.0 wt. % calculated as the oxide and based on total catalyst weight.

13. The process of claim 11 wherein said alumina component is gamma alumina.

14. The process of claim 11 wherein said crystalline molecular sieve component is a Y zeolite.

15. The process of claim 11 wherein said light catalytic cycle oil contains at least about 30 vol. % aromatics.

* * * * *